US007172356B2

(12) United States Patent
Habatjou

(10) Patent No.: US 7,172,356 B2
(45) Date of Patent: Feb. 6, 2007

(54) PACKAGING AND DISPENSING DEVICE WITH DISENGAGING MECHANISM

(75) Inventor: Jacques Habatjou, Cambrai (FR)

(73) Assignee: L'Oreal, Paris (FR)

( * ) Notice: Subject to any disclaimer, the term of this patent is extended or adjusted under 35 U.S.C. 154(b) by 379 days.

(21) Appl. No.: 10/820,870

(22) Filed: Apr. 9, 2004

(65) Prior Publication Data

US 2004/0253036 A1 Dec. 16, 2004

Related U.S. Application Data

(60) Provisional application No. 60/470,500, filed on May 15, 2003.

(30) Foreign Application Priority Data

Apr. 9, 2003 (FR) ..... 03 04431

(51) Int. Cl.
*A45D 40/04* (2006.01)

(52) U.S. Cl. ..... 401/68

(58) Field of Classification Search ..... 401/68, 401/70, 71, 75, 76, 78, 80, 84, 86–88
See application file for complete search history.

(56) References Cited

U.S. PATENT DOCUMENTS 4,417,827 A * 11/1983 Kasai et al. ..... 401/68
5,172,993 A 12/1992 Ackermann et al.
5,813,421 A 9/1998 Wang
6,224,281 B1 * 5/2001 Kim ..... 401/75
6,227,733 B1 * 5/2001 Holloway ..... 401/75

FOREIGN PATENT DOCUMENTS

| | | |
|---|---|---|
| DE | 2629316 | 1/1978 |
| FR | 2620602 | 3/1989 |
| FR | 2755592 | 5/1998 |

* cited by examiner

*Primary Examiner*—Huyen Le
(74) *Attorney, Agent, or Firm*—Oblon, Spivak, McClelland, Maier & Neustadt, P.C.

(57) ABSTRACT

A packaging and dispensing device for a friable product, in particular a cosmetic product. The device includes a hollow base, and a cup intended to accommodate the product in a well. The cup includes at least one lug on a stem fixed below the well. The lug is flexible and engages with a helical groove in the inner wall of the base. The lug can be disengaged from the groove, in particular at the ends of the groove. The arrangement allows "free" rotation in a plane orthogonal to an axis of the spiral. The device includes a sleeve mounted in free rotation about the base, whereas it is fixed in rotation with the cup. The cup moves axially as a function of rotation of the sleeve relative to the base.

58 Claims, 2 Drawing Sheets

PACKAGING AND DISPENSING DEVICE WITH DISENGAGING MECHANISM

CROSS-REFERENCE TO RELATED APPLICATIONS

This document claims priority to French Application Number 03 04431, filed Apr. 9, 2003 and U.S. Provisional Application No. 60/470,500, filed May 15, 2003, the entire contents of which are hereby incorporated by reference.

BACKGROUND OF THE INVENTION

1. Field of the Invention

The invention relates to a packaging and dispensing device, and particularly to a packaging/dispensing device that is suitable for the packaging of friable solid or semi-solid cosmetic products such as lipsticks or block deodorant formulations.

2. Discussion of Background

Packaging devices are known in the prior art, for example, in the arrangement disclosed in FR-A-2,755,592. This arrangement includes a cup containing a friable product, in which the cup incorporates means protruding radially from its outer lateral circumference that engage with a lengthwise groove provided in a first tubular element.

U.S. Pat. No. 5,172,993 also describes a known packaging device for lipstick in which the protruding means on the cup exerts friction as the cup moves relative to a first tubular element. The device includes a second tubular element arranged relative to the first tubular element so that rotation of the first tubular element relative to the second tubular element causes the cup to move in a linear fashion inside the first tube and rotatably inside the second tube, thereby affording access to the product contained in the cup. This relative rotational movement is accomplished by maintaining the respective positions of the two tubular elements relative to a longitudinal axis corresponding to a principal lengthwise axis of the tubular elements.

With the '993 arrangement, the cup is integral in rotation with the first tubular element by virtue of the engagement of the protruding means in the longitudinal groove. The protruding means are also engaged in a helical groove provided on the inner circumference of the second tubular element. With this arrangement, the second tubular element is mounted around the first tubular element. Thus, the first tubular element is disposed inside of the second. In addition, the first tubular element includes a tubular portion extending beyond the second tubular element to provide a grasping zone. This allows the user to take hold of the outer circumference of the second tubular element to rotate it relative to the grasping zone of the first tubular element.

Thus, devices are known which are capable of propelling a cup inside a tubular element from a lower position to an upper position. The product contained in the cup can be rendered inaccessible for direct application to a surface to be coated when in the lower position. The user is therefore repeatedly obliged, at each use, to move the cup from the lower position to the upper position and vice versa. However, because the user does not know the exact number of turns to be applied to the second tubular element relative to the first tubular element, he or she might be induced to force the rotational action at the limit of travel in either the upper position or the lower position, with the risk of disengaging the means protruding radially from the cup from at least one of the grooves.

With devices known in the prior art, relative rotation of the tubular elements ceases to cause the cup to move when the protruding means is disengaged from the groove. The mechanism is disengaged. The protruding means are necessarily rigid elements capable of supporting this rotational and linear propelling action. If they are disengaged from their groove, irreversible deformation of the inner surfaces of the tubular elements can result, and in particular the inner circumference of the second tubular element presenting the helical groove.

SUMMARY OF THE INVENTION

There is a need to provide a device including means capable of supporting the rotational and translational motion respectively entailed in the relative movements of two elements, for example, two tubular elements, which can at the same time be capable of allowing disengagement from a helical groove provided on the inner circumference of one of the tubular elements. The arrangement of the invention provides such a device.

It is another object of the invention to provide a device for packaging and dispensing a product and which has a small number of parts which are easy to assemble.

A disclosed example of the invention includes a base having an inner circumference incorporating a spiral groove, corresponding, for example, to the second tubular element. In addition, a cup is equipped with a riser stem having at least one flexible lug engaging with the spiral in the base. The device also includes a sleeve, corresponding to, for example, the first tubular element, allowing axial translational movement of the cup inside the sleeve by virtue of a cooperative action between the stem and an inner circumference of the sleeve, rendering the cup and integral in rotation. In this case, the sleeve is mounted above the base, and their position relative to a longitudinal axis is maintained even when they are rotated relative to each other.

According to an illustrated example, a packaging and dispensing device for a product, such as a friable cosmetic product, is provided which includes:

a hollow base having a cylindrical inner wall, a cup intended to accommodate the product, and a sleeve formed above the base and free in rotation relative to the base.

The cup moves axially inside the sleeve in response to rotation of the sleeve relative to the base, and the cup is rotatably coupled to the sleeve. In addition, the cup is formed at the end of a stem which, in proximity to a free end of the stem, presents at least one lug engaging with a helical groove in the inner wall of the base. The lug is resiliently supported by the stem so as to be capable of disengaging from the groove at least at one of its ends. Further, the sleeve includes a means to limit the travel of the cup.

Preferably, the cup includes a well to accommodate the product, and the stem is oriented perpendicularly to an outer surface of the bottom of this well, also referred to as the base of the cup. In particular, the stem is placed in the center of the cup base, and is oriented in a direction opposite that in which the product is presented.

The lug is also capable of re-engaging in the helical groove after being disengaged therefrom.

Advantageously, the arrangement to limit travel transversely obstructs the sleeve except that a space is left for an aperture so that the stem can slide through this aperture. For example, the stem has a transverse cross-section complementary with the inner circumference of this aperture so as to be integral in rotation with the sleeve. There is nevertheless a degree of play between the outer circumference of the stem and this aperture to permit unobstructed movement of the stem through the aperture so that the stem can slide or move axially through the aperture. Preferably, a transverse cross-section at the level of the lug is greater than the inner circumference of the aperture.

Advantageously, the arrangement for rotational and translational movement can be, for example, molded in one piece with the sleeve, and can include fluting for example on the inner circumference of the sleeve to delineate the aperture.

Furthermore, the sleeve arrangement can limit the movement of the well inside the sleeve. Thus, by way of example, the stem can preferably have a length defined between the lug and the well bottom that is substantially equal to a height of the sleeve, with this corresponding height defined between the arrangement to limit travel of the cup and a dispensing aperture in the sleeve rendering the product accessible for topical application. Also, by way of example, this stem length is preferably substantially equal to a height of the grooved wall on the center-line of the spiral, i.e., the height inside the base along which the spiral or helical groove is formed.

Advantageously, the sleeve can be mounted on the base in such a way that the sleeve bears on an edge of the base delineating an access to the threaded wall. The lugs on the stem are preferably arranged relative to the stem in such a way that a separation force that is needed to be applied to the stem to cause the lugs to pass through the aperture cannot be obtained by normal manual force. Thus, at the limit of travel with the cup in an upper position inside the sleeve, if continued rotation is exerted on the sleeve relative to the base, the lug is unable to continue its travel so that the lug does not pass through the aperture and, being flexible, the lug is finally disengaged from the helical groove in the base. Furthermore, preferably only the lug(s) on the stem engages with the threaded wall.

To maintain the relative positions of the sleeve in relation to the base, irrespective of the rotational movements respectively applied to them, the sleeve preferably includes a means to prevent linear movement while remaining free in rotation relative to the base. For example, the sleeve can include a flange of circular cross-section on an inner wall designed to engage with a groove provided on an outer circumference of the base.

Preferably, the lug is located on a tab that is flexible relative to the stem, with this flexible tab being held at a free end of the stem opposite the well bottom. In the illustrated example, this flexible tab extends off the stem in a lengthwise axis and incorporates a boss projecting radially from the tab orthogonally to the lengthwise axis of the stem.

According to a preferred example described herein, the stem advantageously has a square or polygonal transverse cross-section, and includes four flexible tabs each having a lug arranged evenly about the periphery. In addition each lug can form a protuberance in the axis of one of the faces of the stem. With this arrangement, the base respectively incorporates four helical grooves each designed to accommodate one of the lugs.

By way of example, the lug can have a variable thickness in a longitudinal cross section along the lengthwise axis of the stem. This thickness diminishes in proximity to a terminal extremity of the lug, and also diminishes in proximity to the junction point between the flexible tab (on which the lug is disposed) and the stem to which the tab is attached.

Further, by way of example, the illustrated example includes a helical groove having a bottom framed by two rims to accommodate the lug, and an angle formed between a first rim and the bottom is different from an angle formed between the second rim and the bottom. This arrangement of the rims is such that, when a lug disengages from its groove, it automatically re-engages into this groove if it is driven in rotation against the edge forming at least an acute angle with the bottom.

Advantageously, the device preferably includes a cap capable of being retained on the base which enables the dispensing aperture on the sleeve to be closed off to render the product inaccessible. The cap preferably completely covers the sleeve and is held on the base, thus preventing rotation of the sleeve relative to the base when the cap is mounted on the device. This arrangement can prevent crushing of the product contained in the cup against the bottom of the cap.

In a variant, the base can be a tube open at both ends and fitted with a bottom cap to close off an opening opposite the aperture through which the helical groove emerges.

By way of example, the invention can be particularly advantageous in devices for dispensing or applying lipsticks having an outside diameter on the order of 8 millimeters.

To simplify the construction of the device according to the invention, its component parts are preferably obtained by molding from thermoplastic materials, such as acrylic, cellulose, styrene or vinyl-based materials, or such as polycarbonates, polyamides, polyolefins, polyethylene terephtalate, and any mixtures of these materials in variable proportions, expanded or non-expanded. The family of materials referred to as "thermoplastic resins" generally can be used.

BRIEF DESCRIPTION OF THE DRAWINGS

The invention will become further apparent from the following detailed description, particularly when considered in conjunction with the drawings in which.

DETAILED DESCRIPTION OF THE PREFERRED EMBODIMENTS

Figure 1A:
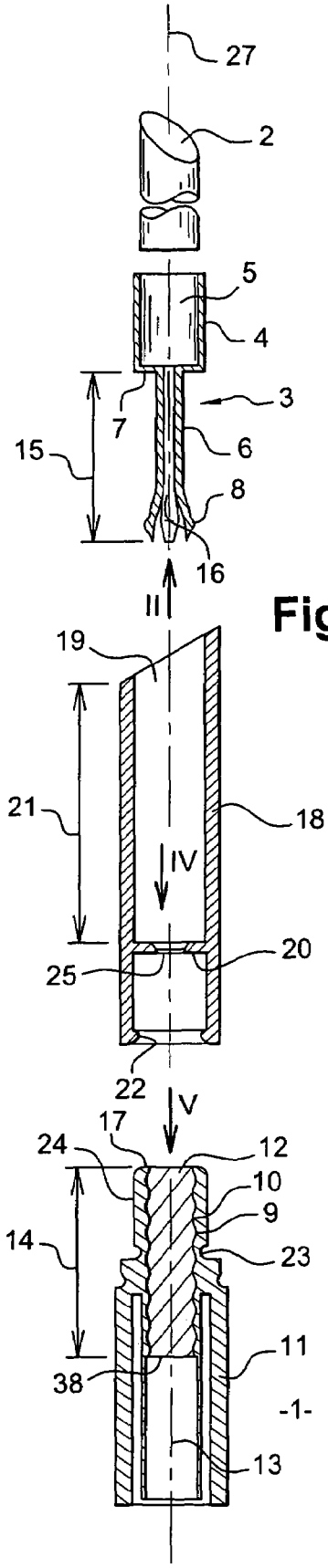
FIG. 1*a* is an exploded lengthwise sectional view of a device according to the invention.

FIG. 1*a* shows a packaging and dispensing device 1 for a product 2. The product 2 is preferably a dispensable product, such as a cosmetic or body hygiene product. In this example, the product 2 takes the form of an oblong truncated tablet for application as lipstick.

The device 1 includes a cup 3 in which the product 2 is placed. In particular, the cup 3 includes a well 4 having a recess 5 designed to hold the product 2 in a stable manner. The recess has a cylindrical shape for example and preferably includes fluting on its inner circumference to facilitate retention of the product tablet 2.

The cup 3 is also fitted with a stem 6 extending perpendicular to the bottom 7 of the well 4. The stem 6 includes at least one lug 8 intended to engage with a groove 9 provided on an inner wall 10 of a base 11 which is recessed to at least partially accommodate the stem 6. In effect, movement of the lug 8 in the groove 9 enables the stem 6 to penetrate more or less deeply into the base 11.

Preferably, the groove 9 has a spiral or helical shape. In the illustrated arrangement, the spiral begins at an inlet aperture 12 in the hollow base 11. The inner wall 10 defines a recess, substantially cylindrical in shape, extending along an axis 13. The stem 6 is inserted parallel to this axis 13 into the base 11. The lug 8 extends radially from the stem 6 to engage with the groove 9.

The spiral formed by the groove preferably has a height 14 on the axis 13 at least equal to a length 15 of the stem 6 defined along this same axis 13 between the bottom 7 and the lug 8. The stem 6 has a free end 16 from which extends the flexible lug 8. With this arrangement, the lug 8 is flexible or movable relative to an axis of the stem 6.

At the inlet aperture 12, the base 11 defines an edge surface 17 against which the bottom 7 bears. When the lug 8 engages with the groove 9, the cup 3 is propelled upward or downward along the axis 13 relative to the base 11. When the well 4 bears against the edge surface 17, the cup 3 is in the lower position relative to the base 11.

To guide the motion of the cup 3 on the axis 13, the device 1 includes a sleeve 18 mounted on the base 11 above the inlet aperture 12. The well 4 can travel from the lower position to an upper position in this sleeve 18. The upper position corresponds to a position of the cup 3 such that the well is in proximity to a dispensing aperture 19 from which the product 2 projects through this opening 19 in order to be applied to a surface. The aperture 19 can be bevelled or slanted for example.

The upper position is limited on axis 13 in that the lug 8 is unable to leave the inlet aperture 12 because the latter is largely closed off by a means 20, for example, one or more ledges or protrusions on the sleeve 18. This means 20 bears against the edge surface 17. In fact, in the lower position, the bottom 7 bears against the means 20 which itself bears against the edge surface 17. In the illustrated arrangement, the length 15 of the stem 6 is substantially equal to a height 21 of the walls forming the sleeve, with this height 21 being defined between the means 20 and at least one edge of the aperture 19.

With the illustrated example, the sleeve 18 is fixed in the direction of linear travel relative to the base 11, but is free in rotation about the axis 13 relative to the base 11. To this end, the sleeve 18 incorporates a flange 22 of semi-cylindrical transverse cross-section designed to snap into a groove 23 formed on the outer circumference 24 of the base 11.

The means 20 is presented for example in the form of at least one protuberance extending radially from the inner circumference of the sleeve 18. The means 20 is disposed at an intermediate position in that it is placed at a distance from the dispensing aperture 19. The means 20 delineates an aperture 25 in which the stem 4 is free to travel along the axis 13. To this end, the aperture 25 defines an opening having an inner circumference slightly larger than the outer circumference of a transverse cross-section of the stem 6.

Figure 1B:
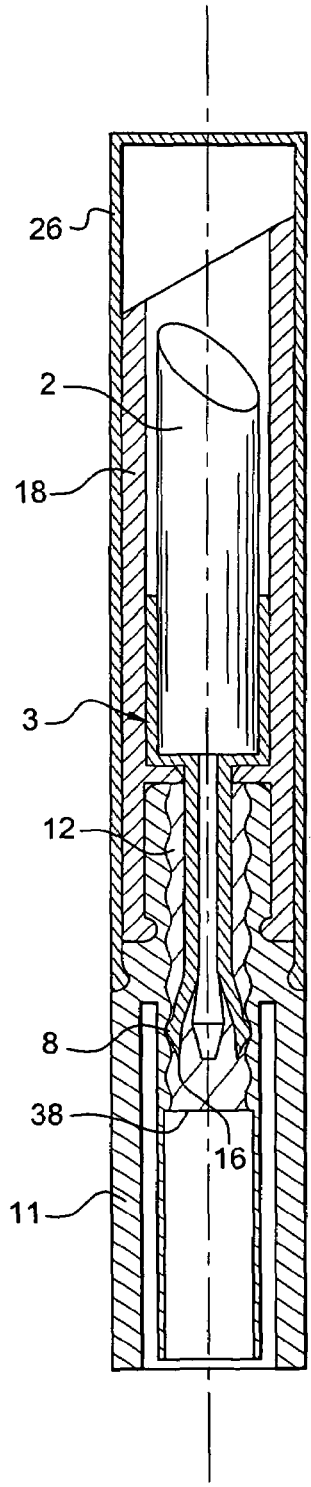
FIG. 1*b* is an assembled longitudinal cross-section of a device according to the invention.

FIG. 1*b* shows the device 1 of FIG. 1*a* in the assembled state with the cup 3 in the lower position relative to the sleeve 18. The device 1 includes a cap 26 fitted around the sleeve 18 so as to close off the dispensing aperture 19. The cap 26 is preferably retained on the outer circumference 24 so as to prevent undesired rotation of the sleeve 18 relative to the base 11.

Figure 2:
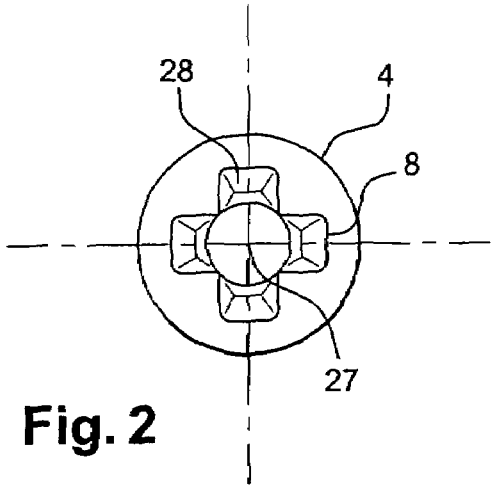
FIG. 2 is a view from a free end of a cup of a device according to the invention.

In the illustrated example, the cup 3 is integral in rotation with the sleeve 18. In other words, the cup 3 rotates with the sleeve. By way of example, this integral relationship can be obtained by cooperation between the inner surface of the aperture 25 which has a shape complementary to the outer surface of a transverse cross-section of the stem 6. Preferably, the cross-section of the stem 6 is polygonal, and the inner circumference of the aperture 25 is also polygonal. For example, as illustrated in FIG. 2, the stem 6 is square in transverse cross-section, i.e., orthogonally to the axis 13. In a complementary manner, the aperture 25 defines a square space slightly larger than the stem 6 to permit sliding movement without friction.

Thus when opposing or relative rotational movements are applied to the sleeve 18 and the base 11, as shown in FIG. 1*b*, rotation of the cup 3 relative to the base 11 is obtained. This rotation causes the lug 8 to move in the groove 9, thereby raising or lowering the well 4 in the sleeve 18.

In a variant, in particular as illustrated in FIG. 2, the cup 3 includes four lugs such as 8 designed to engage respectively with four grooves such as 9. These four lugs are arranged to project beyond each face of the stem, which has a square cross-section in the illustrated example. The lugs each project radially outward beyond the outer circumference relative to a principal lengthwise axis 27 of the stem 6. This principal lengthwise axis 27 is superimposed on axis 13 in the assembled state, as illustrated in FIG. 1*b*.

The lugs are preferably mounted on flexible tabs such as 28 at the end 16 of the stem 6. A flexible tab 28 is attached to an end 29' of the stem 6. This attachment is made principally as an extension of a face of the stem 6.

Preferably, at the point of attachment 29', a thickness 30 of the tab in a longitudinal sectional view parallel to the lengthwise axis 27 is lessened relative to a thickness 31 of a portion of the tab 28 having a protuberance 32 intended to form the lug 8 engaging with the groove 9. This thickness 31 also preferably diminishes in proximity to a terminal end 29" of the lug. The attachment end 29 and the terminal end 29" enclose the protuberance 32, or in other words, the protuberance is formed between the attachment end and the terminal end.

Figure 3:
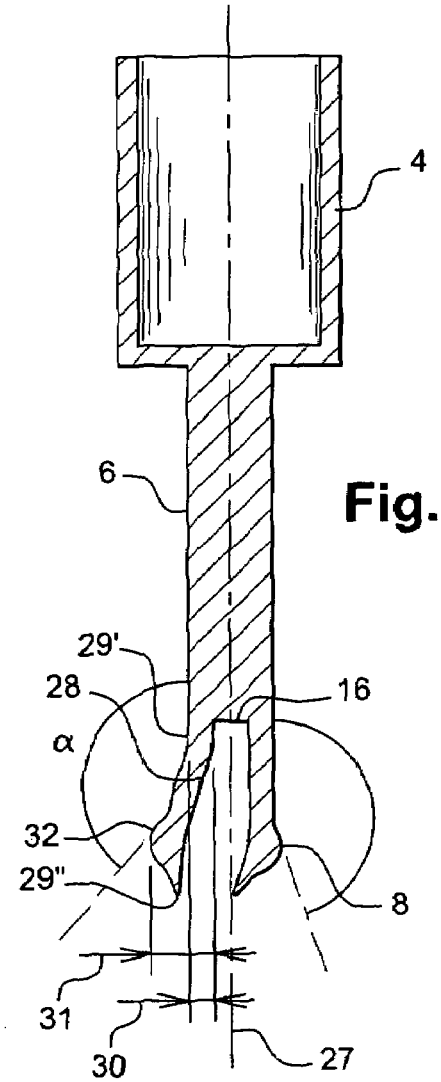
FIG. 3 is a longitudinal cross-section of a cup of a device according to the invention.

By virtue of the limited thickness 30 at the point of attachment 29', the tab 28 may form a variable angle $\alpha$ relative to the axis 27. The angle $\alpha$ is defined between an outer circumference connecting the protuberance 32 to the point of attachment 29' and the axis 27. This angle $\alpha$ is obtuse. It may vary for example between 90° and 120°, while retaining its elasticity, depending on the strain exerted on the flexible tab 28. In FIG. 3, for example, the flexible tab such as 28 shown on the right of the stem 6 is under strain. Nevertheless, even with the protuberance 32 pushed back to this degree, the lug 8 cannot pass through the aperture 25 in the intermediate means 20. Therefore, when the cup 3 is in the upper position, and the protuberance 32 bears against an inner rim of the aperture 25, if rotational force continues to be applied to the sleeve 18 relative to the base 11, the flexible tab 28 is forced back and eventually could leave the groove 9. This therefore constitutes a disengaging mechanism.

The lug 8 cannot pass through the aperture 25 under normal manual pressure. In fact, although the aperture 25 has an inner circumference greater than the outer circumference of a cross-section of the stem 6, the aperture 25 preferably has an inner circumference smaller than the outer circumference defined by a transverse cross-section at the lug 8. The lug 8 is formed on a flexible tab 28, but even when this tab 28 is compressed to the maximum towards the axis 13, the transverse cross-section at the tab 8 preferably remains larger than the cross-section defined by the inner circumference of the aperture 25. In this position the lug 8 is held permanently under the means 20, which positively prevents the cup 3 disengaging from the base 11 and/or from the sleeve 18.

Figure 4:
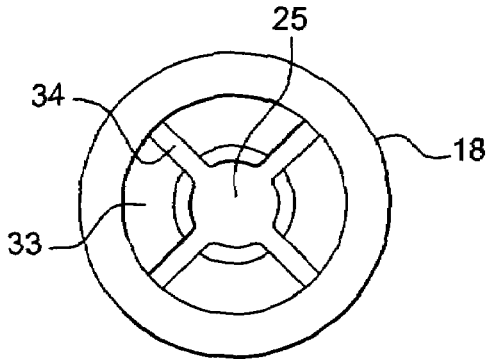
FIG. 4 is a transverse sectional view of a sleeve of a device according to the invention.

For assembly purposes, as indicated in FIG. 4, provision can be made for the intermediate means or protrusion 20 to be formed by several folds 33 extending radially inward into the sleeve 18. These folds, illustrated by way of example at 33, delineate slots such as 34 communicating with the central aperture 25. The presence of these slots 34 combined with the flexibility of the tabs 28, enables the cup 3 to be inserted into the sleeve 18 from the dispensing aperture 19, and ensures that the lug 8 can pass through the means 20 for assembly. Assembly is accomplished, for example, by a machine, applying a force greater than an average or normal manual forces.

Figure 5:
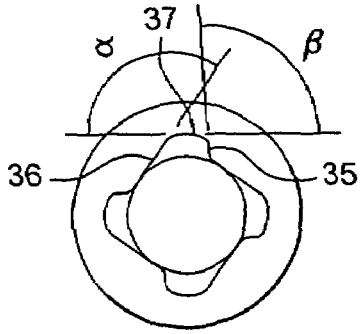
FIG. 5 is a top view of a base of a device according to the invention.

In order to re-engage the lug 8 on the flexible tab 28 in the groove 9 after it disengages in an uppermost position of the cup, it is simply necessary to apply an opposite rotational movement to the sleeve 18 relative to the base 11, and the lug 8 returns to its relaxed position when it is presented at the entry to the groove 9. In addition, by virtue of the shape of the groove 9, the rotational movement then positively engages the lug 8 in the groove. In effect, when it is at the entry to the groove, depending on the rotation applied to it, through the sleeve 18, the protuberance 32 on the lug may come into contact with a first edge or rim 35 or a second edge or rim 36 of the groove. These edges 35 and 36 are connected to the bottom of the groove 37 (FIG. 5).

When the lug 8 rises relative to (or along) the axis 13 in the groove 9, it bears principally against the first edge 35, whereas when its descends in the groove 9 it comes into contact mainly with the second edge 36. Preferably, these two edges each form a different angle in relation to the bottom of the groove 37. The first edge 35 forms a more acute angle $\beta$ than the angle $\gamma$ formed by the second edge 36 (FIG. 5). Depending on the rotation applied, in the upper disengaged position, if the lug is pushed in the direction of the first edge 35, it does not engage or catch in the groove 9, whereas if it is pushed in the direction of the second edge 36, it automatically engages in the groove 9.

Similarly, the entry 38 of the groove 9 on the side opposite the aperture 12 also serves to disengage and re-engage the lug 8 in this same groove 9.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A packaging and dispensing device for a product, including:

a hollow base having a cylindrical inner wall, a cup which accommodates the product, a sleeve which is positioned at least partially above the base, wherein the sleeve is rotatable relative to the base, wherein the cup moves axially inside the sleeve in response to rotation of the sleeve relative to the base, and further wherein the cup is rotatably coupled to the sleeve, such that the cup rotates when the sleeve rotates, wherein the cup is formed at the end of a stem, and wherein the stem has at least one lug in proximity to a free end of said stem, and wherein said at least one lug engages with a helical groove in the cylindrical inner wall of the base, and further wherein said lug is resiliently supported by the stem on a tab which forms an obtuse angle with a portion of the stem to which the tab is attached so as to be capable of disengaging from the groove at least at one end of the groove, and wherein the sleeve comprises means to limit the travel of the cup.

2. A device according to claim 1, wherein a portion of the stem is oriented perpendicularly to a bottom of a well formed by the cup, and the stem is positioned at a center of said bottom.

3. A device according to claim 1, wherein the means to limit the travel of the cup closes off the sleeve transversely while leaving sufficient space for an aperture, and wherein the stem slides through said aperture.

4. A device according to claim 3, wherein the stem comprises a transverse cross-section complementary with an inner periphery of said aperture such that said stem is integral in rotation with the sleeve.

5. A device according to claim 4, wherein a transverse cross-section at a level of the lug is larger than the inner periphery of the aperture.

6. A device according to claim 3, wherein a transverse cross-section at a level of the lug is larger than the inner periphery of the aperture.

7. A device according to claim 1, wherein a length of said stem defined between the lug and the bottom of the cup is equal to a height of the sleeve, on the axis of the helical groove, between the means to limit travel and a dispensing aperture in the sleeve.

8. A device according to claim 7, wherein the means to limit travel bears on an edge surface of the base delineating an access to the cylindrical inner wall.

9. A device according to claim 8, wherein a length of said stem defined between the lug and a bottom of the cup is equal to a height of the cylindrical inner wall having the helical groove on the axis of the helical groove.

10. A device according to claim 1, wherein the means to limit travel bears on an edge surface of the base delineating an access to the cylindrical inner wall.

11. A device according to claim 1, wherein a length of said stem defined between the lug and a bottom of the cup is equal to a height of the cylindrical inner wall having the helical groove on the axis of the helical groove.

12. A device according to claim 1, wherein the sleeve includes a flange on an inner wall to engage with a groove provided on an outer circumference of the base.

13. A device according to claim 12, wherein said flange has a semi-cylindrical cross-section.

14. A device according to claim 12, wherein the tab is flexible relative to the stem, and wherein the tab is positioned in proximity to the free end of the stem.

15. A device according to claim 1, wherein the tab is flexible relative to the stem, and wherein the tab is positioned in proximity to the free end of the stem.

16. A device according to claim 15, wherein the stem includes four lugs evenly distributed about a periphery of the stem, and wherein each lug forms a protuberance.

17. A device according to claim 1, wherein the stem includes four lugs evenly distributed about a periphery of the stem, and wherein each lug forms a protuberance.

18. A device according to claim 1, wherein the at least one lug has a variable thickness in a longitudinal cross-section along an axis of the stem, wherein the thickness diminishes in proximity to a terminal extremity of the lug toward the free end of the stem.

19. A device according to claim 1, wherein the helical groove includes a bottom framed by first and second rims to accommodate the lug, and wherein a first angle formed between the first rim and the bottom is different from a second angle formed between the second rim and said bottom, and further wherein this arrangement of the rims causes the lug to re-engage in the helical groove if it is caused to rotate against the second rim.

20. A device according to claim 1, further including a cap capable of being retained on the base.

21. A device according to claim 1, wherein the base is a tube open at both ends.

22. A device according to claim 1, wherein said product is a lipstick product.

23. A device according to claim 1, wherein said product is a cosmetic product.

24. A device according to claim 1, wherein said cup is movable between a lowermost position and an uppermost position, and wherein in said uppermost position, engagement between said at least one lug and said means to limit travel prevents further upward movement of said cup, and wherein in said lowermost position said means to limit travel is sandwiched between a bottom of said cup and a top of said base.

25. A device according to claim 1, wherein said stem rotatably couples said sleeve to said cup.

26. A packaging and dispensing device for a product comprising:

a base having at least one helical groove associated therewith;

a cup within which the product is disposed;

a sleeve which is at least partially disposed above the base, and wherein said sleeve is rotatable relative to said base, said sleeve including a portion having a first cross-section; and a stem extending from said cup, said stem having a first end coupled to said cup and a second end, and wherein at least one lug is disposed on a tab on said stem proximate said second end, said tab forming an obtuse angle with the first end of the stem, wherein said stem extends through said portion of said base and said stem is movable axially through said portion, and further wherein said first cross-section is arranged with respect to a cross-section of said stem at a location between said at least one lug and said first end of said stem such that said portion of said sleeve is coupled to said stem whereby upon rotation of said sleeve said stem rotates to thereby rotate said cup, and further wherein said at least one lug does not pass through said portion of said sleeve thereby limiting axial movement of said stem and said cup, and wherein said at least one lug engages with said helical groove such that as the sleeve is rotated relative to said base, said at least one lug moves along said helical groove to cause axial movement of said stem and said cup with respect to said sleeve.

27. A packaging and dispensing device according to claim 26, wherein said stem has a plurality of lugs associated therewith.

28. A packaging and dispensing device according to claim 27, wherein said base has a plurality of helical grooves associated therewith.

29. A packaging and dispensing device according to claim 28, wherein said portion of said sleeve includes at least one protrusion.

30. A packaging and dispensing device according to claim 29, wherein said portion of said sleeve defines a non-circular aperture and said stem has a non-circular cross-section.

31. A packaging and dispensing device according to claim 29, wherein said at least one protrusion at least partially defines an aperture delimiting said first cross-section, and wherein said stem extends through said aperture.

32. A packaging and dispensing device according to claim 31, wherein said aperture defines at least a portion of a polygonal shape.

33. A packaging and dispensing device according to claim 26, wherein said portion of said sleeve includes at least one protrusion.

34. A packaging and dispensing device according to claim 33, wherein said at least one protrusion at least partially defines an aperture delimiting said first cross-section and through which said stem extends.

35. A packaging and dispensing device according to claim 34, wherein said aperture defines at least a portion of a polygonal shape.

36. A packaging and dispensing device according to claim 26, wherein said at least one lug includes a first tapered portion disposed between said lug and said second end of said stem.

37. A packaging and dispensing device according to claim 36, wherein said at least one lug is disposed on a flexible portion of said stem.

38. A packaging and dispensing device according to claim 26, wherein said cup is movable between a lowermost position and an uppermost position, and wherein in said lowermost position said portion of said sleeve is sandwiched between a bottom of said cup and a top of said base.

39. A packaging and dispensing device according to claim 38, wherein said portion of said sleeve prevents said at least one lug from moving higher when said cup is in said uppermost position.

40. A packaging and dispensing device according to claim 39, wherein the helical groove includes a bottom framed by first and second rims to accommodate the at least one lug, and wherein a first angle formed between the first rim and said base is different than a second angle formed between said second rim and said base.

41. A packaging and dispensing device according to claim 40, wherein said second angle is larger than said first angle.

42. A packaging and dispensing device according to claim 40, wherein said at least one lug disengages from said helical groove when said cup is in the uppermost position and relative rotation between said sleeve and said base causes said at least one lug to re-engage with said helical groove.

43. A packaging and dispensing device according to claim 26, wherein the helical groove includes a bottom framed by first and second rims to accommodate the at least one lug, and wherein a first angle formed between the first rim and said base is different than a second angle formed between said second rim and said base.

44. A packaging and dispensing device according to claim 43, wherein said second angle is larger than said first angle.

45. A packaging and dispensing device according to claim 43, wherein said at least one lug disengages from said helical groove when said cup is in an uppermost position and relative rotation between said sleeve and said base causes said at least one lug to re-engage with said helical groove to move said cup downwardly.

46. A packaging and dispensing device according to claim 26, wherein said product is a cosmetic product.

47. A packaging and dispensing device according to claim 26, wherein said product is a lipstick.

48. A packaging and dispensing device comprising:

a base having at least one helical groove associated therewith;

a sleeve coupled to said base such that said sleeve is rotatable relative to said base, said sleeve including a portion at least partially defining an aperture;

a cup rotatably coupled to said sleeve such that when said sleeve is rotated relative to said base said cup is rotated relative to said base, and wherein said cup is slidable relative to said sleeve to move said cup between a lowermost position and an uppermost position; and a stem extending from a bottom of said cup, said stem including a first end connected to said cup and a second end, and wherein at least one lug is disposed on a tab proximate to said second end, said tab forming an obtuse angle with the first end of the stem, and wherein said stem extends through said aperture of said portion of said sleeve and said stem moves through said aperture as said cup is moved between said lowermost position and said uppermost position, wherein said at least one lug does not pass through said aperture to thereby prevent said cup from moving beyond said uppermost position.

49. A packaging and dispensing device according to claim 48, wherein when said cup is in said lowermost position said portion of said sleeve is sandwiched between the bottom of said cup and a top of said base.

50. A packaging and dispensing device according to claim 49, wherein said aperture is rotatably coupled to said stem to thereby rotatably couple said cup to said sleeve.

51. A packaging and dispensing device according to claim 48, wherein said aperture is rotatably coupled to said stem to thereby rotatably couple said cup to said sleeve.

52. A packaging and dispensing device according to claim 48, wherein said stem includes a plurality of lugs associated therewith.

53. A packaging and dispensing device according to claim 52, wherein said base includes a plurality of helical grooves.

54. A packaging and dispensing device according to claim 48, wherein said aperture is a polygonal aperture.

55. A packaging and dispensing device according to claim 48, wherein said helical groove includes a bottom formed by first and second rims to accommodate said at least one lug, and wherein a first angle formed between said first rim and said bottom is different from a second angle formed between said second rim and said bottom, and wherein said second angle is larger than said first angle.

56. A packaging and dispensing device according to claim 48, wherein said at least one lug is disengaged from said helical groove when said cup is in said uppermost position.

57. A packaging and dispensing device according to claim 48, wherein said product is a cosmetic product.

58. A packaging and dispensing device according to claim 48, wherein said product is a lipstick.

* * * * *